US006340073B1

(12) United States Patent
Lee et al.

(10) Patent No.: US 6,340,073 B1
(45) Date of Patent: Jan. 22, 2002

(54) ELEVATOR DOOR SYSTEM

(75) Inventors: Gwang Nam Lee, Anyang-shi; Hak Gi Han, Seoul; Woo Young Lim, Ilsan-shi, all of (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/455,788

(22) Filed: Dec. 7, 1999

(30) Foreign Application Priority Data

Dec. 7, 1998 (KR) ..... 98-53403

(51) Int. Cl.[7] ..... B66B 13/12; B66B 13/20

(52) U.S. Cl. ..... 187/309; 187/310; 187/319; 187/330; 49/360; 49/120

(58) Field of Search ..... 187/307–312, 187/318, 319, 321, 322, 324, 325, 327–330, 331, 333–335; 49/360, 116, 118, 120, 123

(56) References Cited

U.S. PATENT DOCUMENTS 3,863,390 A * 2/1975 Sawdai ..... 49/360
4,926,974 A 5/1990 Morris et al.
4,926,975 A 5/1990 Morris
5,246,089 A * 9/1993 Husmann et al. ..... 187/319
5,377,785 A 1/1995 Pearson
5,636,714 A 6/1997 Viola

* cited by examiner

*Primary Examiner*—Eileen D. Lillis
*Assistant Examiner*—Thuy V. Tran

(57) ABSTRACT

An improved elevator door system for reducing vibration and noise in opening/closing a car door and a hatch door and allowing fast operation by releasing a landing door lock device before the car door moves. The elevator door system includes a hatch door; a car door; a motor for providing rotating force to open and close the hatch door and the car door; power transmitting means; a rack for possibly moving horizontally by the power transmitting means; a pinion engaged with the rack for rotating by horizontal movement of the rack; clutch connected to the pinion for transmitting or cutting off power toward the hatch door; and door lock engaged with the clutch, the door lock positioned in a lock release state in which the hatch door is movable when the clutch transmits power, while positioned in a lock state for fixing position of the hatch door when the clutch cuts off power.

5 Claims, 4 Drawing Sheets

ELEVATOR DOOR SYSTEM

BACKGROUND OF THE INVENTION

1. Technical Field

The present invention relates to an elevator door system for opening and closing a car door in an elevator system in connection with and together with a hatch door in each floor, and more particularly to an improved elevator clutch device for releasing a landing door lock device before operating the car door so to reduce vibration and noise in opening/closing the car door and hatch door as well as enable the elevator moving fast.

2. Description of the Prior Art

As well known to the skilled, the elevator system includes a car door installed to an elevator car moving through hoistway in a building, and a hatch door installed to a hall leading to the hoistway in each floor of the building. Therefore, in order that passengers board on or off the elevator, both of the car door and the hatch door should be opened. In addition, power is required to open the car and hatch doors, the elevator system employs only one driving source in the elevator so to open/close the car door and the hatch door together without using separate driving power sources in consideration of economy. Therefore, the elevator system needs another device for operating the car door and the hatch door together.

In order to open/close the car door and the hatch door together with use of one driving power source installed in the elevator, the elevator system commonly employs a clutch device for connecting the car door and the hatch door so to open/close together when the elevator stops at a floor. On the other hand, if the hatch door is opened by hand when the elevator car is not on a suitable position, there can be a risk of a person or matter to fall into the hoistway through the hatch door. Therefore, a landing door lock device is essential to the elevator system in order to lock the hatch door not opened by hand, and to unlock the hatch door only when the car door starts opening in state that the elevator car stops in a designated position.

FIG. 1 is a front view for showing a clutch device and a belt-type door driving unit employed in the conventional elevator system viewed from the hatch door. FIG. 2 is a front view for showing the landing door lock device of the hatch door installed to the elevator system viewed from the car door. FIG. 3 and FIG. 4 show states of the landing door lock device respectively locked and unlocked by the elevator clutch device. The conventional elevator clutch device in relation with such landing door lock device of the hatch door is explained with reference to the accompanying drawings.

Referring to FIG. 1 at first, a driving motor 2 is mounted to a car frame 1. The driving motor 2 drives a driving pulley 4 at a reduced rotating ratio through a belt 3. In addition, the driving pulley 4 circulates a timing belt 6 connected to a driven pulley 5. Left and right car doors 7, 7' are integrally hung on hanger plates 8, 8', which are movably suspended on a rail 9 mounted on the car frame 1. Furthermore, one hanger plate 8 is configured to be directly led by the timing belt 6. On the other hand, though not shown in the figure, the car doors 7, 7' are connected to each other through a separate rope. When one door 7 moves, the rope moves the other door 7' to an opposite direction at the same time such that the car doors open.

In addition, a clutch device 10 is shown in FIG. 3 and FIG. 4 as a conventional landing door lock device. As shown in FIGS. 3 and 4, the clutch device 10 includes a fixed clutch bar 12 and a movable clutch bar 13 mounted parallel vertically to a base 11 fixed to the hanger plate 8 of one car door 7. Clutch arms 14, 14' are mounted beside the movable clutch bar 13 in order to move the movable clutch bar 13 in parallel to the fixed clutch bar 14. In addition, a cam plate 15 is fixedly mounted to a portion of the car frame 1, and an interlocking roller 16 is connected to the movable clutch bar 13. The cam plate 15 and the interlocking roller 16 are interlocked to change a space between the fixed and movable clutch bars 12, 13 according to position of the car door 7.

When the car doors 7, 7' are closed, the interlocking roller 16 is seated on the cam plate 15, whereby the movable clutch bar 13 of the clutch device 10 is lifted upward. Because the movable clutch bar 13 moves in linkage with the clutch arms 14, 14', the space between the fixed and movable clutch bars 12, 13 is broadened with the movable clutch bar 13 lifted. When the elevator car moves vertically, the fixed and movable clutch bars 12, 13 move with the space broadened. In addition, when the elevator car moves vertically, a lock release roller 21 of the landing door lock device 20 mounted to one hanger plate 18 of the hatch doors 17, 17'in each floor shown in FIG. 2 passes through the broadened space between the fixed and movable clutch bars 12, 13. When the elevator car stops at a hall in a certain floor, the lock release rollers 21 of the landing door lock device 20 are positioned between the fixed and movable clutch bars 12, 13 as shown in FIG. 3. Of course, before the car door opens, space between the fixed and movable clutch bars 12, 13 is in broaden state, and at that time the latch 22 of the landing door lock device 20 is hooked up the locker 23. Therefore, the hatch doors 17, 17' are maintained not to be opened by hand.

When the car doors close as shown in FIG. 3, the driving motor 2 shown in FIG. 1 is activated such that the car doors 7, 7' are led by the timing belt 6. Then, one car door 7 at which the clutch device 10 is installed moves to an opening direction (left in the drawing). Therefore, as shown in FIG. 4, the interlocking roller 16 comes down along the cam plate 15 so that the movable clutch bar 13 moves downward. At this time, the movable clutch bar 13 is particularly geared with the clutch arms 14, 14' so to reduce distance to the fixed clutch bar 12. If the space between the fixed and movable clutch bars 12, 13 is narrowed, the lock release rollers 21 of the landing door lock device 20 interposed therebetween become upright from their inclined state (FIG. 3). According to that, as shown in FIG. 4, the latch 22 fixed in a locking state by the lock release rollers 21 becomes released from the locker 23. Therefore, from that time, the hatch door becomes led by the car door and opened at the same time with the lock release rollers 21 restrained in a narrowed space between the fixed and movable clutch bars 12, 13. Closing process of the hatch door and the car door is contrary to the above opening process.

In addition, a micro switch 24 is installed in the landing door lock device 20. The micro switch 24 is in contact with an actuator 25 attached to the latch 22 when the landing door lock device 20 is in a locking state, while the micro switch 24 is turned off when the landing door lock device 20 is in an unlocking state. Therefore, when contacting with the micro switch 24, the actuator 25 activates the micro switch 24 so to inform that the landing door lock device 20 is in the locking state.

However, in such conventional technique, a spatial gap is created because the clutch device should move a certain distance in order to release the landing door lock device of the hatch door after the car begins to open. Due to the spatial gap, when an initial opening speed is set fast, mechanical collision may arise in the release process of the landing door lock device. In addition, because the hatch door is hardly controlled in a process of closing up the car door, the hatch doors close with colliding with each other due to the speed of the car door. Such mechanical collision of the doors and severe vibration and noise caused therefrom may cause uneasiness of passengers and shorten lift cycle of the elevator system.

Therefore, the conventional elevator sets up speed of the car door slow in order to prevent mechanical collision and vibration and noise therefrom, which causes decreasing capacity of the elevator and inconvenience of passengers boarding on/off the elevator.

SUMMARY OF THE INVENTION

Therefore, the present invention is designed to overcome the above problems of the prior art. An object of the present invention is to provide an improved elevator door system for opening and closing car doors and hatch doors at the same time which minimizes collision, vibration and noise in the door opening/closing process and enables door speed to be set fast by means of releasing a landing door lock device of the hatch door in advance before the car door starts opening in consideration that a factor of the problem is a gap between the conventional clutch device and the landing door lock device of the hatch door.

In order to accomplish the object, the present invention provides an elevator door system comprising: a hatch door mounted on each floor in a building through which passengers board on/off an elevator; a car door installed to an elevator car through which passengers board on/off the elevator; a motor mounted on the elevator car for providing rotating force to open and close the hatch door and the car door; power transmitting means for converting the rotating force to power in order to move the hatch door to an opening or closing position; a rack connected to the power transmitting means for possibly moving horizontally in accordance with the power transmitting means; a pinion engaged with the rack for rotating by horizontal movement of the rack; clutch means connected to the pinion for transmitting or cutting off power toward the hatch door; and door lock means engaged with the clutch means, the door lock means positioned in a lock release state in which the hatch door is movable when the clutch means transmits power, while positioned in a lock state for fixing position of the hatch door when the clutch means cuts off power.

The elevator door system may include rack locking means for locking or unlocking the rack in relation to the pinion.

In the elevator door system, the clutch means may include a pair of clutch bars extended vertically parallel with facing each other, the clutch bars being movable near to or far from each other; a pair of clutch arms having first clutch arm pivoted to upper ends of the clutch bars and second clutch arm pivoted to lower ends of the clutch bars, the clutch arms moving a pair of the clutch bars near to or far from each other; and a pair of links, one ends of which are connected to the first clutch arm, the other ends of which are connected to the pinion in order to transmit rotating force of the pinion to the first clutch arm.

In the elevator door system, the rack lock means may include the rack having a horizontal elongated opening perforated therein; a guide rod which is movable horizontally in the elongated opening; a lock lever for possibly rotating to a position of restraining movement of the guide rod or a position of releasing movement of the guide rod, the lock lever having a hook for restraining the guide rod; a roller provided to one end of the lock lever; and a plate having a plane portion and an inclined portion for providing travel surface to the roller.

The rack lock means may further include a spring for biasing the lock lever to a position of restraining the guide rod.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

Hereinafter, preferred embodiments of the present invention will be described in detail with reference to the accompanying drawings.

Figure 5:
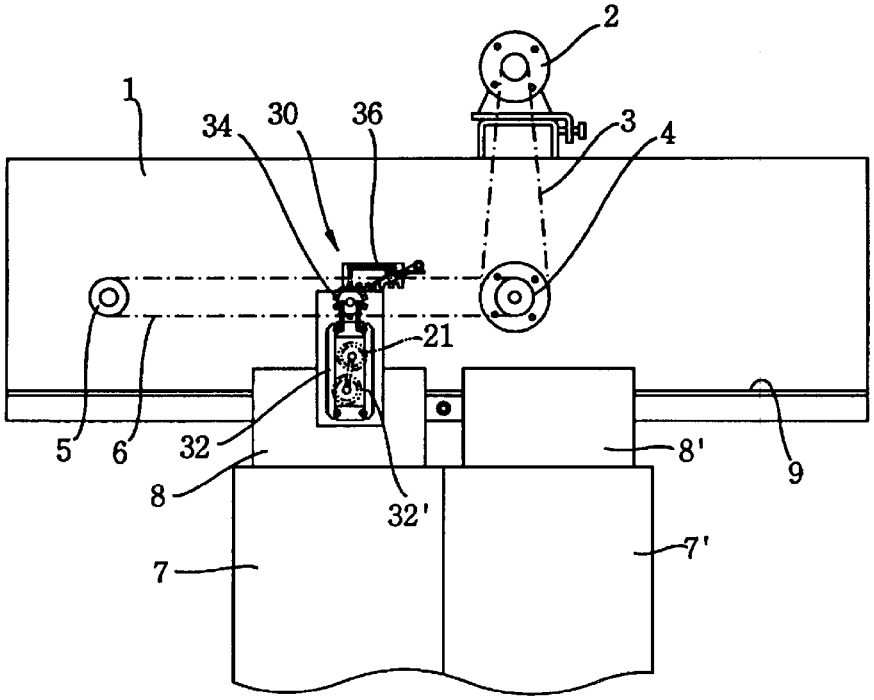
FIG. 5 is a front view for showing an elevator door system according to the present invention viewed from the hatch door.

Referring to FIG. 5 at first, the driving motor 2 is installed to the car frame 1 like the conventional art. The driving motor 2 drives the driving pulley 4 at a reduced rotating ratio through the belt 3. In addition, the driving pulley 4 circulates the timing belt 6 connected to the driven pulley 5. Left and right car doors 7, 7' are integrally hung on hanger plates 8, 8', which are movably suspended on the rail 9 mounted on the car frame 1. Unlike to the prior art, the hanger plate 8, of the car door 7 is not directly connected to the timing belt 6, but connected to the timing belt 6 through an element of a clutch device described below so to be led by the element. On the other hand, though not shown in the figure, the car doors 7, 7' are connected to each other through a separate rope. When one door 7 moves, the rope moves the other door 7' to an opposite direction at the same time such that the car doors open.

Figure 1:
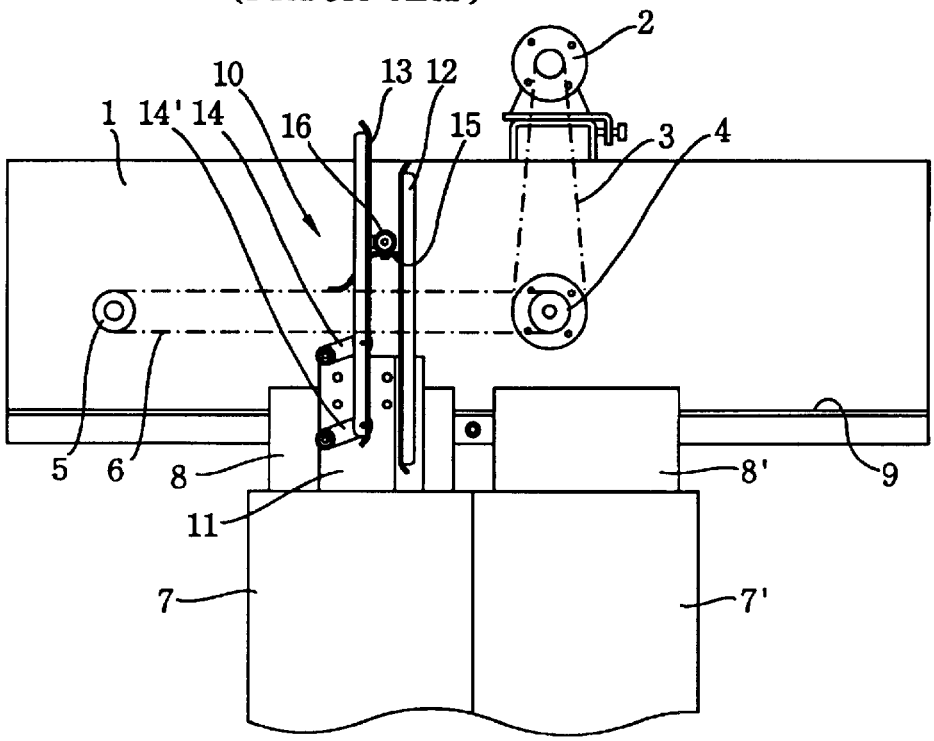
FIG. 1 (PRIOR ART)
FIG. 1 is a front view for showing a conventional elevator door system viewed from the hatch door.
Figure 2:
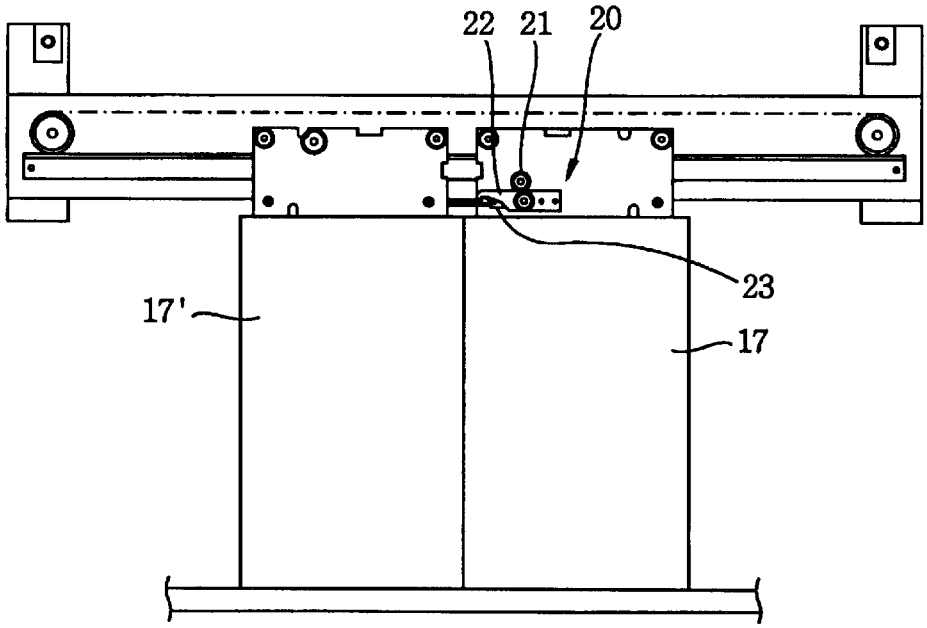
FIG. 2 (PRIOR ART)
FIG. 2 is a front view for showing the conventional elevator door system viewed from the car door.
Figure 3:
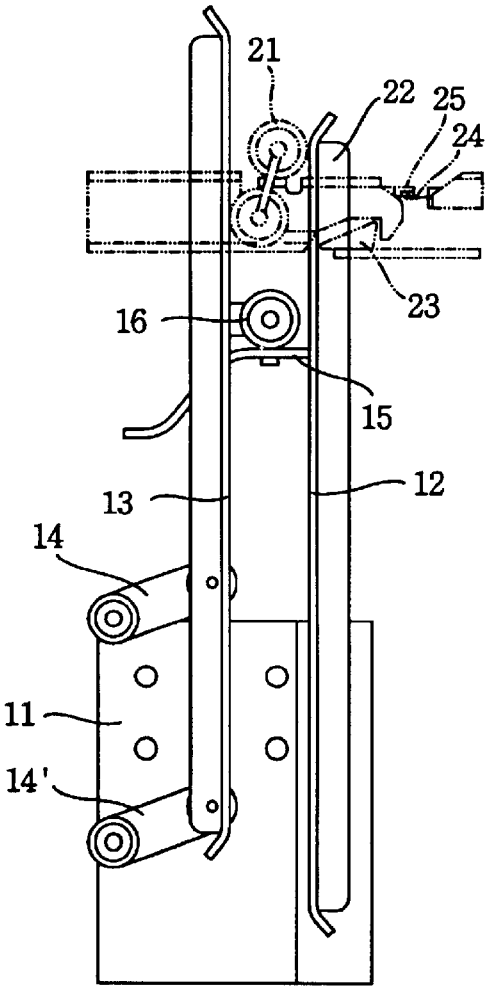
FIG. 3 (PRIOR ART)
FIG. 3 is a front view showing that the landing door lock device of the hatch door and the clutch device of the conventional elevator are locked.
Figure 4:
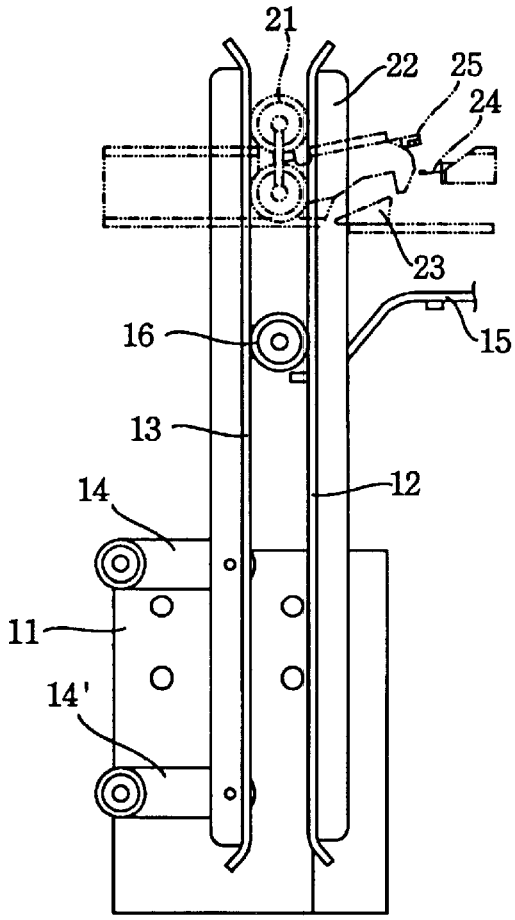
FIG. 4 (PRIOR ART)
FIG. 4 is a front view showing that the landing door lock device of the hatch door and the clutch device of the conventional elevator are unlocked.
Figure 6:
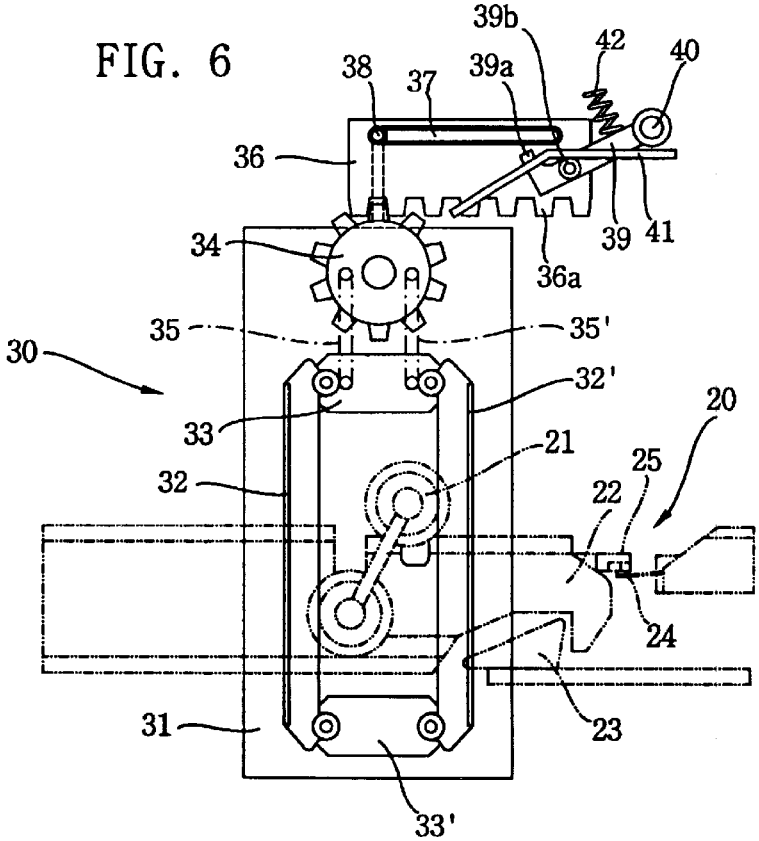
FIG. 6 is a front view showing that the elevator clutch device and the landing door lock device of the hatch door according to the present invention are locked.
Figure 7:
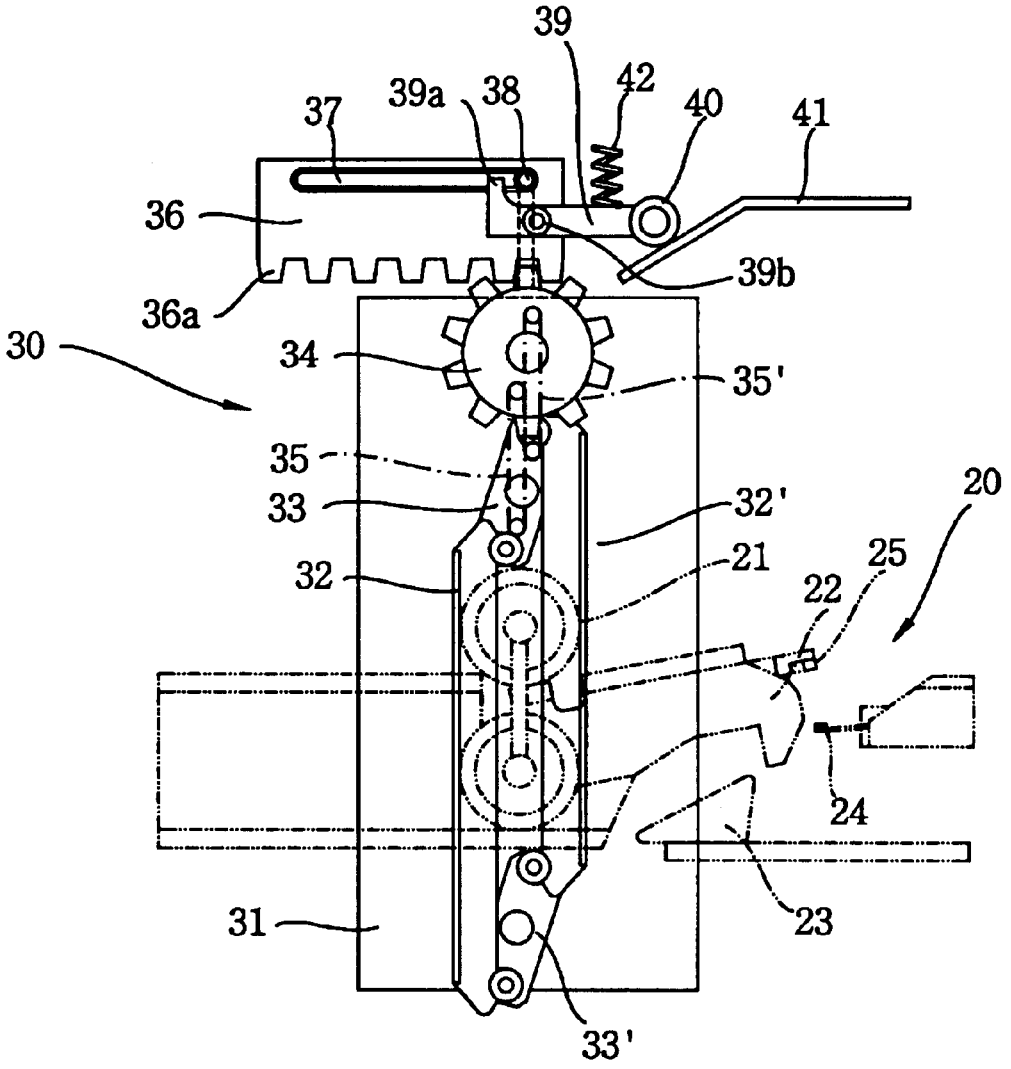
FIG. 7 is a front view showing that the elevator clutch device and the landing door lock device of the hatch door according to the present invention are unlocked.

FIG. 6 is a front view showing that the elevator clutch device 30 and the landing door lock device 20 of the hatch door are locked, while FIG. 7 is a front view showing that the elevator clutch device 30 and the landing door lock device 20 of the hatch door are unlock. Referring to the figures, a pair of clutch bars 32, 32' are installed to a base 31 fixed to the hanger plate 8 of one car door 7. A pair of the clutch bars 32, 32' are mounted vertically in parallel, between which lock release rollers 21 of the landing door lock device 20 used for locking the hatch doors 17, 17' may be interposed (FIG. 2). In addition, both ends of the clutch bars 32, 32' areinterconnected by clutch arms 33, 33'. The clutch arms 33, 33' are rotatably combined to the base 31 such that the clutch bars 32, 32'may be linked by rotation of the clutch arms 33, 33' so to change space between the clutch bars . In addition, the upper clutch arm 33 is connected to a pinion 34 through a pair of links 35, 35'. The pinion 34 is also engaged with a rack 36, which can be directly led by the timing belt 6. Therefore, when the rack 36 is moving linearly by the timing belt 6, the pinion 34 becomes rotated, and then the clutch arms 33, 33' linked with the links 35, 35' are also rotated so to change space between the clutch bars 32, 32'.

The rack 36 has a horizontal elongated opening 37, through which a guide rod 38 combined to the base 31 is inserted. The guide rod 38 horizontally moves in the horizontal elongated opening 37 according to movement of the rack 36. A region in which the guide rod 38 moves within the horizontal elongated opening 37 is corresponding to a clutching region where the landing door lock device locks or unlocks the hatch doors 17, 17'. The guide rod 38 has a shape of reversed "L", and the dashed portion extended vertically in FIG. 6 and FIG. 7 is extended downward at the rear of the rack 36 and combined with the base 31.

A rack lock lever 39 is rotatably attached to one side of the rack 36 by a pivot pin 39b fixed to the rack 36. The rack lock lever 39 has a hook 39*a* in one end thereof, the other end of which is connected to an interlocking roller 40. The interlocking roller 40 is positioned on the cam plate 41 when the car doors 7, 7' are closed. At this time, the cam plate 41 consists of a plane portion horizontally extended in a slightly higher position than the pivot pin 39*b* of the rack lock lever 39, and an inclined portion sloped downward from one end of the plane portion. While the rack 36 moves in the clutching region, the interlocking roller 40 either rides on the plane portion of the cam plate 41 or descends along the inclined portion. When the rack 36 moves in the clutching region during a door opening process, the guide rod 38 moves from one end of the horizontal elongated opening 37 (left end in the drawing paper).

When the interlocking roller 40 is moving downward along the inclined portion of the cam plate 41, the rack lock lever 39 rotates on the pivot pin 39*b* so that the hook 39*a* in one end of the rack lock lever 39 may shut and fix the guide rod 38 in one end of the horizontal elongated opening 37. If the hook 39*a* of the rack lock lever 39 fixes the guide rod 38, the state that space between the clutch bars 32, 32' is narrowed by rotation of the pinion 34 engaged with the rack 36 can be maintained through the door opening/closing process. In addition, it is preferred that a spring 42 for pressing the rack lock lever 39 is provided in order to maintain the state of restraining the guide rod 38. The cam plate 41 is fixed to the car frame 1, and thus not moves laterally in the door opening/closing process.

In the clutch device described above, both of a pair of the clutch bars 32, 32' are configured to be movable in linkage with the pinion 34 and the link 35. In addition, the rack 36 moves with being engaged with the pinion 34 in the clutching region, which corresponds to a distance of the guide rod 38 to move in the horizontal elongated opening 37. At this time, rotating angle of the pinion 34 is preferably about 90 degrees, or less.

Further more, the micro switch 24 and the actuator 25 are installed in the landing door lock device 20 of the hatch door. Same as the prior art, the micro switch 24 is in contact with an actuator 25 when the landing door lock device 20 is in a locked state. At this time, the actuator 25 activates the micro switch 24 so to inform that the landing door lock device 20 is in the locked state.

The elevator door system as constructed above will be explained in detail in conjunction with run of the elevator car. In state that the car doors 7, 7' are closed and the elevator car is movable, the hatch doors 17, 17' are, of course, locked by the landing door lock device 20 as described above. In this state, the rack 36 is positioned in a direction to which the door is closed and the guide rod 38 is positioned in a left end of the horizontal elongated opening 37 formed in the rack 36. In addition, at this time, the interlocking roller 40 is on the cam plate 41, and thus the hook 39*a* of the rack lock lever 39 is departing from a right end of the horizontal elongated opening 37. In addition, the pinion 34 is engaged with left end of gear 36a formed in the rack 36, and space between a pair of the clutch bars 32, 32' is widest. When the elevator car moves vertically in the hoistway, the lock release rollers 21 of the landing door lock device 20 for locking the hatch doors 17, 17' can pass through the broaden space between the clutch bars 32, 32'.

When the elevator car moves and stops at a certain floor, the lock release rollers 21 of the landing door lock device 20 which is locking the hatch doors 17, 17' in the corresponding floor become interposed into the wide space between the clutch bars 32, 32'. Because the space between the clutch bars 32, 32' is sufficiently wide, the latch 22 of the landing door lock device 20 is continuously locked by the locker 23. Therefore, the hatch doors 17, 17' cannot be still opened by hand.

If the driving motor 2 is activated to open the door in the closed state as shown in FIG. 5, the timing belt 6 circulates by the driving motor to a corresponding direction, and the rack 36 connected to the timing belt 6 thus moves to a door-open direction. While region in which the rack 36 moves can be classified into an initial clutching region of gearing a pair of the clutch bars 32, 32' for unlocking the hatch doors 17, 17' and a door moving region in which the doors substantially moves.

That is, the clutching region corresponds a region where the guide rod 38 connected to the base 31 fixed to the car door 7 moves from a left end (FIG. 6) of the horizontal elongated opening 37 and then is hooked on and restrained at a right end (FIG. 7) toward a door opening direction. In such clutching region, the car doors 7, 7' and the hatch doors 17, 17' do not open, while the rack 36 moves. Moreover, in the clutching region, the pinion 34 rotates about 90 degrees according to movement of the rack 3(6 as shown in FIG. 7, and the space between a pair of the clutch bars 32, 32' becomes narrow by linkage of the links 35, 35' and the clutch arms 33, 33'. Of course, the guide rod 38, at this time, moves from the left end to right end of the horizontal elongated opening 37.

If the space between the clutch bars 32, 32' becomes narrow, the lock release rollers 21 of the landing door lock device 20 interposed therebetween become upright from their inclined state as shown in FIG. 7, which makes the latch 22 escaped from the locker 23 so to unlock the hatch doors 17, 17'. Therefore after that, the rack 36 leads the car door 7 restrained to a door opening direction by the guide rod 38 hooked in the right end of the horizontal elongated opening 37, and the car doors 7, 7'lead the hatch doors 17, 17' unlocked by the lock release rollers 21 interposed between the clutch bars 32, 32'. According to that, the car doors 7, 7' and the hatch doors 17, 17' may open simultaneously.

On the other hand, the rack lock lever 39 attached to and moving together with the rack 36 rotates while the interlocking roller 40 slides downward along the cam plate 41, in FIG. 7. While the rack lock lever 39 rotates, the guide rod 38 is restrained between the right end of the horizontal elongated opening 37 and the hook 39*a* of the rack lock lever 39, resulting that restraint relation between the rack 36 and the car door 7 can be maintained. At this time, the spring 42 helps the rack lock lever 39 continuously restraining the car door 7 securely.

Such restraint relation between the rack 36 and the car door 7 is maintained in the door closing process until the interlocking roller 40 of the rack lock lever 39 climbs on the cam plate 41 again. In addition, because the guide rod 38 is fixed to the right end of the horizontal elongated opening 37 of the rack 36, space between a pair of the clutch bars 32, 32' is not widened in the door closing process. That is, the elevator door system of the present invention prevents the clutch device 30 from moving freely, which improves safety.

The door closing process is contrary to the door opening process. That is, after the car doors 7, 7' and the hatch doors 17, 17' are closed completely, the hatch doors 17, 17' are then locked again. After that the elevator car may move vertically.

As described above, the present invention improves the clutch device for opening or closing the car door and the hatch door simultaneously, in which the hatch door is unlocked before opening the door and locked again after closing the door in order to make the door opening/closing operation smooth and stable.

In addition, the elevator door system of the present invention may provide agreeableness and convenience in passenger transportation by minimizing noise at the start of opening door and at the end of closing door and reducing time for the door opening/closing process.

Therefore, the present invention is effective to remove uneasiness of passengers and lower breakdown ratio of the system, and facilitates efficiency of passenger transportation by shortening the door opening/closing time such that time of passengers getting on/off the elevator car can be reduced.

The elevator door system according to the present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. Elevator door system comprising:

a hatch door mounted on each floor in a building through which passengers board on/off an elevator;

a car door installed to an elevator car, through which passengers board on/off the elevator;

a motor mounted on the elevator car for providing rotating force to open and close the hatch door and the car door;

power transmitting means for converting the rotating force to power in order to move the hatch door to an opening or closing position;

a rack connected to the power transmitting means for possibly moving horizontally in accordance with the power transmitting means;

a pinion engaged with the rack, the pinion rotating by horizontal movement of the rack;

clutch means connected to the pinion for transmitting or cutting off power toward the hatch door; and door lock means engaged with the clutch means, the door lock means positioned in a lock release state in which the hatch door is movable when the clutch means transmits power, while positioned in a lock state for fixing position of the hatch door when the clutch means cuts off power.

2. Elevator door system as claimed in claim 1, wherein the clutch means comprises:

a pair of clutch bars extended vertically parallel with facing each other, the clutch bars being movable near to or far from each other;

a pair of clutch arms having first clutch arm pivoted to upper ends of the clutch bars and second clutch arm pivoted to lower ends of the clutch bars, the clutch arms moving a pair of the clutch bars near to or far from each other; and a pair of links, one ends of which are connected to the first clutch arm, the other ends of which are connected to the pinion in order to transmit rotating force of the pinion to the first clutch arm.

3. Elevator door system as claimed in claim 1, further comprising rack locking means for locking or unlocking the rack in relation to the pinion.

4. Elevator door system as claimed in claim 3, wherein the rack lock means comprises:

the rack having a horizontal elongated opening perforated therein;

a guide rod which is movable horizontally in the elongated opening;

a lock lever for possibly rotating to a position of restraining movement of the guide rod or a position of releasing movement of the guide rod, the lock lever having a hook for restraining the guide rod;

a roller provided to one end of the lock lever; and a plate having a plane portion and an inclined portion for providing travel surface to the roller.

5. Elevator door system as claimed in claim 4, wherein the rack lock means further comprises a spring for biasing the lock lever to a position of restraining the guide rod.

* * * * *